US007942952B2

(12) United States Patent
Gale

(10) Patent No.: US 7,942,952 B2
(45) Date of Patent: May 17, 2011

(54) SINGLE STAGE ELECTROSTATIC PRECIPITATOR

(76) Inventor: Roger Gale, Oslo (NO)

( * ) Notice: Subject to any disclaimer, the term of this patent is extended or adjusted under 35 U.S.C. 154(b) by 492 days.

(21) Appl. No.: 12/084,199

(22) PCT Filed: Oct. 27, 2006

(86) PCT No.: PCT/NO2006/000378

§ 371 (c)(1),
(2), (4) Date: Jul. 31, 2008

(87) PCT Pub. No.: WO2007/053028

PCT Pub. Date: May 10, 2007

(65) Prior Publication Data

US 2008/0307973 A1 Dec. 18, 2008

(30) Foreign Application Priority Data

Nov. 1, 2005 (NO) ..... 20055113

(51) Int. Cl.
*B03C 3/08* (2006.01)

(52) U.S. Cl. ..... 96/63; 96/77; 96/79; 96/97

(58) Field of Classification Search ..... 96/63, 77–79, 96/96, 97; 95/79

See application file for complete search history.

(56) References Cited

U.S. PATENT DOCUMENTS

| | | | | | |
|---|---|---|---|---|---|
| 2,318,093 | A * | 5/1943 | Penney | 96/79 |
| 3,704,572 | A | 12/1972 | Gourdine et al. | |
| 3,747,299 | A * | 7/1973 | Chiang | 95/79 |
| 4,056,372 | A * | 11/1977 | Hayashi | 96/87 |
| 4,231,766 | A | 11/1980 | Spurgin | |
| 4,257,258 | A | 3/1981 | Bovenlander | |
| 4,351,648 | A | 9/1982 | Penney | |
| 5,248,324 | A * | 9/1993 | Hara | 96/37 |
| 5,466,279 | A * | 11/1995 | Hattori et al. | 96/69 |
| 5,547,496 | A * | 8/1996 | Hara | 96/79 |
| 5,707,428 | A * | 1/1998 | Feldman et al. | 96/54 |
| 6,506,238 | B1 * | 1/2003 | Endo | 96/79 |
| 6,635,106 | B2 * | 10/2003 | Katou et al. | 96/67 |
| 7,517,503 | B2 * | 4/2009 | Botvinnik et al. | 422/186.04 |
| 2003/0221999 | A1 * | 12/2003 | Weaver et al. | 209/129 |
| 2006/0016336 | A1 * | 1/2006 | Taylor et al. | 96/25 |

FOREIGN PATENT DOCUMENTS

| | | | |
|---|---|---|---|
| DE | 855 099 | | 11/1952 |
| DE | 102 60 590 | | 7/2004 |
| JP | 6-165949 | A * | 6/1994 |

OTHER PUBLICATIONS

International Search Report mailed Mar. 2, 2007 for International Application No. PCT/NO2006/00378.

* cited by examiner

*Primary Examiner* — Richard L Chiesa
(74) *Attorney, Agent, or Firm* — Wenderoth, Lind & Ponack, L.L.P.

(57) ABSTRACT

In an electrostatic precipitator for filtering particulate matter from a gas, a fan (10) draws the gas (5) through an ioniser section (7) and a collector section (6). Ioniser blades (3) with sawtooth spikes (8) create a corona discharge (4) when charged to a high voltage, so that gas-borne particles are charged when passing through the corona area. The collector section (6) consists of a set of metallic plates (1, 2) of which every other plate (1) is connected to ground, while the remaining plates (2) receive a charge by induction from the ioniser blades (3), and act as repeller plates, pushing charged particles in the gas flow (5) over to the grounded plates (1).

5 Claims, 4 Drawing Sheets

Induction Cell Plan

Figure 1. Ioniser

Figure 2 Induction Powered Cell

Figure 3 Induction Cell Plan

SINGLE STAGE ELECTROSTATIC PRECIPITATOR

This application is the national stage of PCT Application No. PCT/NO2006/000378, filed on Oct. 17, 2006.

TECHNICAL FIELD

The present application relates to apparatus for filtering particulate matter from gasses and more particularly to electrostatic filters which are adapted to remove particles by charging gas-borne particles by means of an ioniser arrangement and thereafter precipitating the charged particles in a collector section with differently charged parallel plates. Typically these filters will be used to remove particulate from air streams.

BACKGROUND ART

The prior art includes filters using the principle of electrostatics for removing particles from various gasses; normally air, at velocities up to 10 m/s. The principle here employed is as follows. The air is propelled through an electric field where particles in the air receive an electric charge. The charged particles move into a collector section where each alternate plate is charged with the same polarity as the particles, and repels them. The other set of plates are grounded, which collect the particles. The remaining air, cleaned of the majority of particles, is then re-introduced into the environment. Washing cleans the contaminated plates, normally by water/detergent, high-pressure air or other means. The particles can be charged positively or negatively depending on the environment and the location of the filter.

While the electrostatic filter has evolved over the years there remain two basic operational problems. In the event of the filter collector section being shorted out or electrically discharging, the ioniser loses its charge. When this happens, the filter loses the ability to collect particulate for the time that the ioniser is discharged. In the event that the collector section is shorted, then the collector, ioniser and associated filter cells are discharged and fail to collect particulate matter.

SUMMARY OF THE INVENTION

Accordingly, it is the object of this invention to provide an improved electrostatic filter for the filtering of gaseous borne particulate.

It is another object of this invention to provide an improved electrostatic filter, which may be easily assembled.

It is a further object of this invention to provide an improved electrostatic filter, which may be easily tested for proper assembly.

It is still another object of this invention to provide an improved electrostatic filter whose elements are not easily broken.

It is yet another object of this invention to provide an improved electrostatic filter, which may be installed with cost savings.

It is another object of the invention to make an electrostatic filter function with little maintenance.

The above mentioned objects are obtained by the provision of an apparatus such as defined in the appended claims.

DETAILED DESCRIPTION OF THE INVENTION

Figure 3:
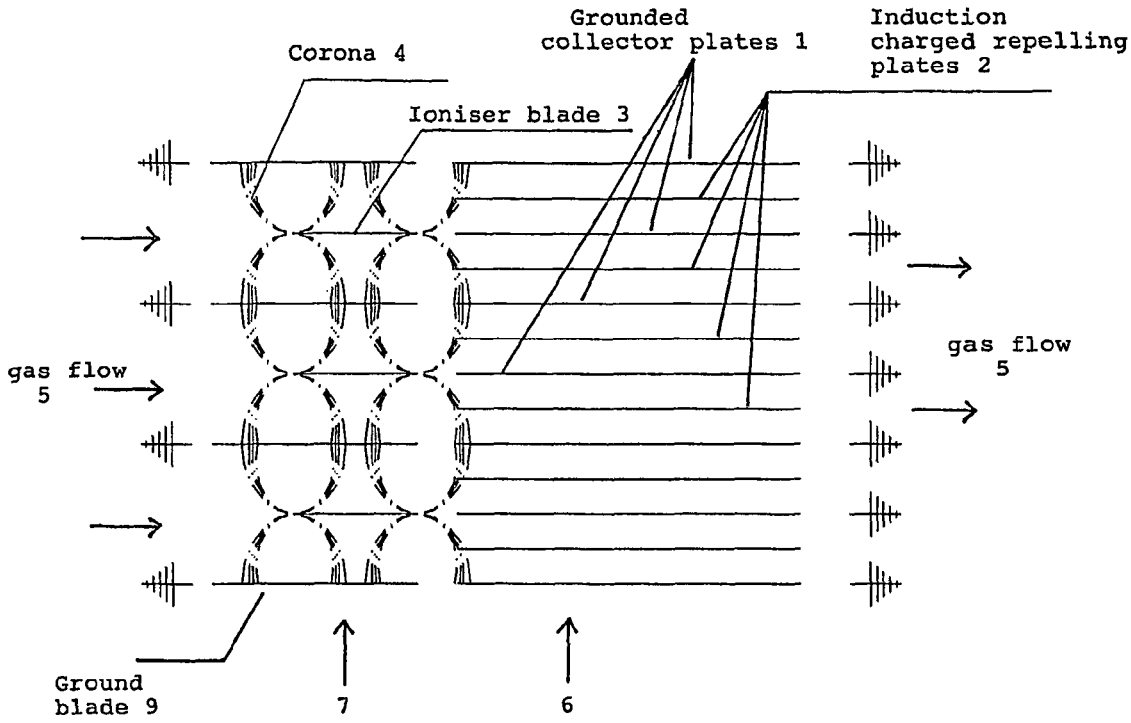
FIG. 3 is a plan view showing an embodiment of the apparatus in accordance with the invention.

Referring to FIG. 3, which shows a preferred embodiment of the invention schematically, the electrostatic filter utilises a series of parallel flat conduction plates 1, 2 and flat 'saw tooth' ioniser blades 3 (with sharp teeth 8) standing parallel to and in front of the conduction plates 1,2. The flat 'saw tooth' ioniser blades 3 are placed so that they are lying in the same plane as some of the conduction plates 1,2. The ioniser blades 3 are charged to a high potential typically greater than 11000 volts DC. The ioniser blades 3 have such a width, in the direction of gas flow 5, that they induce a voltage in some 2 of the parallel conduction plates. The parallel conduction plates 2 are not electrically connected to a power supply. The ioniser blades 3 and complementary ground blades 9 constitute together an ioniser section 7. The ground blades 9 are arranged substantially between and parallel to the ioniser blades 3 for assisting in providing a corona discharge 4 from the ioniser blades 3 when a high voltage is applied thereto. Due to the design of the ioniser section 7 the parallel conduction plates 2 are charged to a high DC voltage by induction. The amount of this charge depends on the design of the ioniser and the distance to the collector section 6.

As particles pass through the corona 4, they are given a charge, which has the same potential as that of the ioniser blades 3. As the particles pass into the collector section 6, the conduction plates 2 have the same induced charge as the particles. This has the effect of repelling the particles towards the conduction plates 1 that are connected to ground. When the particles come into contact with the ground conduction plates 1, the ground conduction plates 1 hold the particles.

The filter cell 6, 7 has an ionising charge on its ioniser blades 3. This induces a, charge in some of the plates 2 in the collector section 6 of the cell. Should the collector discharge, then only that particular cell is affected. Should one set of collector/ground plates be shorted to ground, then only this part of the cell is affected and the ionising part continues to charge the particles as they move through the corona. Some of these particles then pass into the shorted section of the collector. In this part both plates are at ground. Therefore both plates will attract particles, which come within the field of attraction. In the rest of the collector section, operation may continue unaffected.

All plates and blades are conductive, preferably made of a metal.

Figure 1:
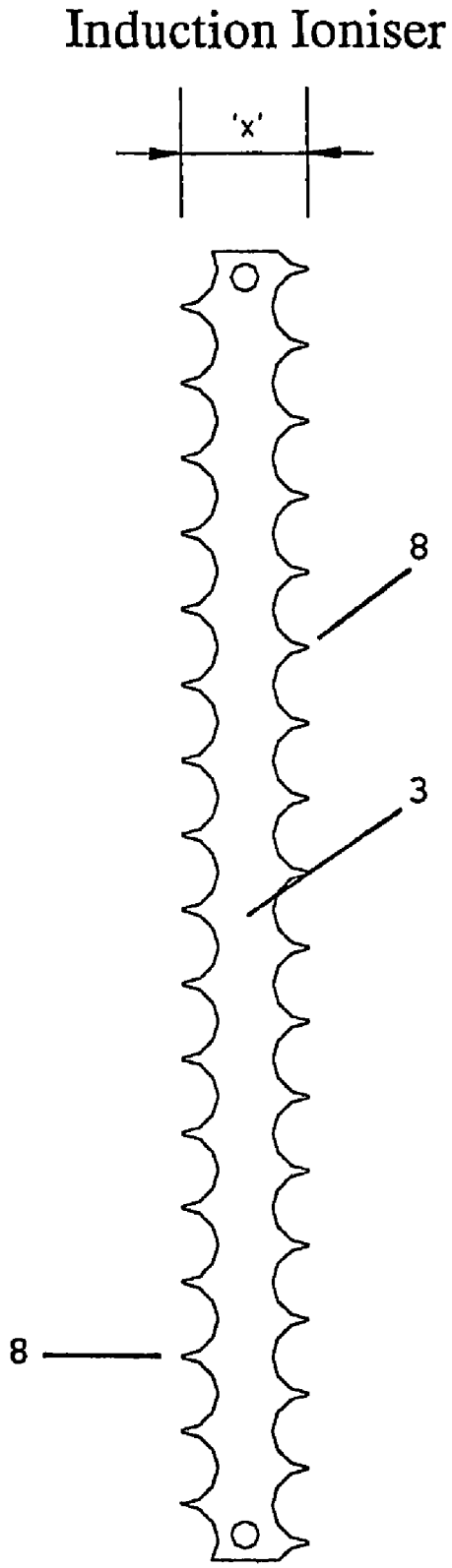
FIG. 1 is a side view of one ioniser blade.
Figure 2:
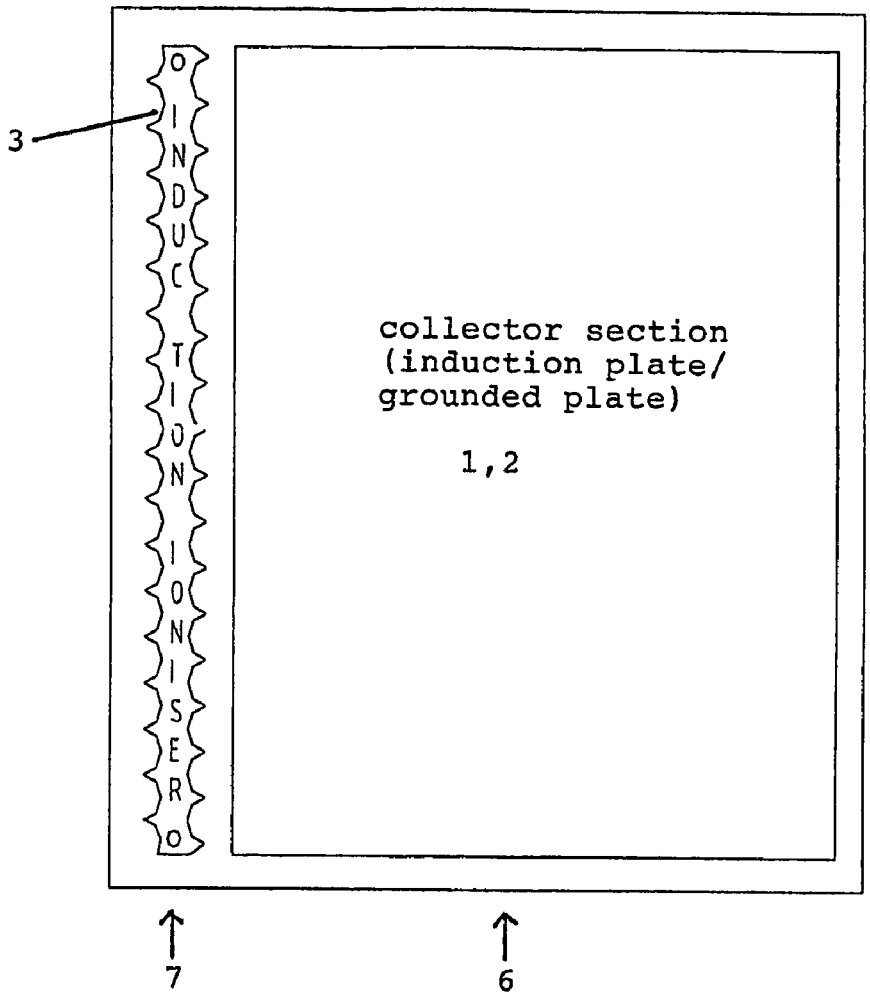
FIG. 2 is a side view of an induction-powered cell, showing generally the upstream ioniser blades and the downstream collector section.

The ioniser blade shown in FIG. 1 is scalloped, and the width is such that the rear spikes induce a voltage in non-connected plates in the collector section. FIG. 2 shows the relative position of the ioniser in relation to the collector plate. The distance between the ioniser blade and the collector section plates is important in determining the induced voltage. In FIG. 3 the earth can be either negative or positive. The ionising voltage can be either negative or positive but it is to be the opposite of the earth. The earth plates 1 and induction plates 2 are separated electrically so that they are independent of one another.

Figure 4:
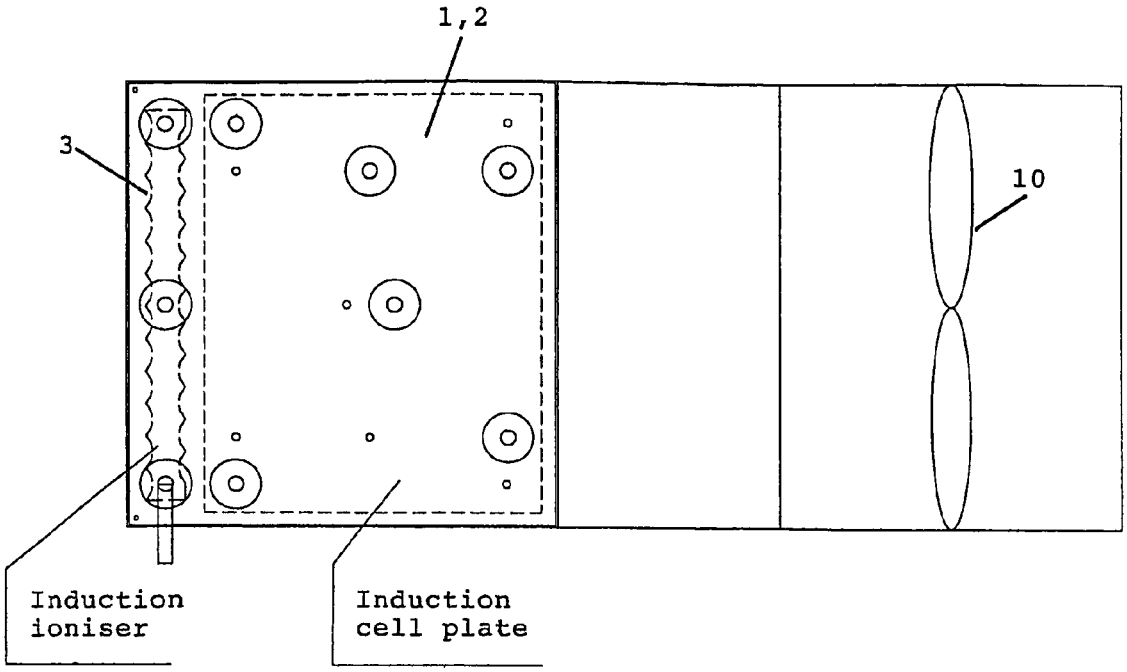
FIG. 4 shows a complete apparatus including a fan.

In FIG. 4 appears the arrangement of a fan 10 for sucking gas with particles through the filter sections, first the ioniser section with a set of induction ioniser blades 3 and ground blades 9, and then through the collector section that contains alternate earth contact plates 1 and induction cell plates 2. The Induction ioniser blades 3 have a high voltage, which causes a corona discharge 4. The corona discharge contacts the induction cell plate 2. The corona creates a voltage in the cell plate 2. The cell plate 2 is isolated from the cell earth. This isolation causes the induction cell plate 2 to act as a capacitor. The induction effect also causes any charged particle to be repelled from the plate 2. This particle is then forced over to the earth contact plate 1. This earth contact plate 1 is connected to earth electrically.

So, every other plate 1 in the collector section 6 is connected to ground, while the remaining collector plates 2 are without any electrical connection. Preferably, each ioniser blade 3 lies substantially in the same plane as a grounded collector plate 1. Preferably, the ground blades 9 in the ioniser section 7 lie substantially in the same planes as every other grounded collector plate 1, while the non-connected remaining plates 2 for inductive charging in the collector section 6 lie in alternate planes between the planes defined by the ioniser blades 3 and the ground blades 9.

Preferably, the ioniser blades 3 are supported by stays that act at the same time as electrical conductors for high voltage to the blades 3.

The system uses a high ionising voltage to induce a voltage in the collector section. The size of the collecting voltage depends on the depth of the ioniser and size of the voltage. A 50 mm ioniser gives say 4 kV, while a 65 mm ioniser gives 6 kV for the same ionising voltage.

The filter apparatus of the patent invention is tolerant to having water in contact with the collector section without damage to the filter or the collector section. Further, the inventive filter apparatus is more economical to use than non-induction voltage filters. The filter apparatus of the invention requires less maintenance than non-induction voltage filters. Also, on being discharged to earth, the filter apparatus does not affect other cells which can be connected electrically to the ioniser section of the discharged cell. And, importantly, the filter apparatus still retains the ability to remove particles from the air even when the collector section is discharged to earth.

The invention claimed is:

1. An apparatus for filtering particulate matter from a gas, the apparatus comprising:

a collector section comprising a plurality of parallel collector plates for receiving electrically charged particles borne by a flow of the gas;

an ionizer section located upstream of said collector section, said ionizer section comprising a plurality of ground blades and a set of conductive ionizer blades parallel to said collector plates, said conductive ionizer blades each having a number of sharp teeth at least along its edges, in sawtooth fashion; and a fan for drawing the gas through said ionizer section and said collector section, wherein every other one of said collector plates in said collector section is connected to ground and a remainder of said collector plates are without any electrical connection, said remainder of collector plates thereby being arranged to be charged electrically by induction from said conductive ionizer blades when said conductive ionizer blades are charged to a high voltage.

2. The apparatus of claim 1, further comprising a plurality of stays for supporting said ionizer blades, said stays being electrical conductors for supplying high voltage to said conductive ionizer blades.

3. The apparatus of claim 1, wherein said ground blades in said ionizer section are arranged substantially between and parallel to said conductive ionizer blades, for assisting in providing a corona discharge from said conductive ionizer blades when a high voltage is applied thereto.

4. The apparatus of claim 3, wherein each of said conductive ionizer blades lies substantially in the same plane as one of said grounded collector plates.

5. The apparatus of claim 4, wherein said ground blades lie substantially in the same planes as every other one of said grounded collector plates, said remainder of collector plates for inductive charging in said collector section thereby lying in alternate planes between planes defined by said conductive ionizer blades and said ground blades.

* * * * *